United States Patent [19]

Kyoshima

[11] Patent Number: 4,952,947

[45] Date of Patent: Aug. 28, 1990

[54] INK DISCHARGE RECOVERY DEVICE HAVING AT LEAST ONE SUCTION-APPLYING CONDUIT LOCATED AT A PARTICULAR POSITION IN A CAPPING MEMBER AND AN INK JET RECORDING APPARATUS INCORPORATING THE DEVICE

[75] Inventor: Masayuki Kyoshima, Kawasaki, Japan

[73] Assignee: Canon Kabushiki Kaisha, Tokyo, Japan

[21] Appl. No.: 271,312

[22] Filed: Nov. 15, 1988

[30] Foreign Application Priority Data

Nov. 17, 1987 [JP] Japan ..... 62-288433
Nov. 14, 1988 [JP] Japan ..... 63-285865

[51] Int. Cl.[5] ..... B41J 2/165
[52] U.S. Cl. ..... 346/140 R
[58] Field of Search ..... 346/140

[56] References Cited

U.S. PATENT DOCUMENTS 4,383,263 5/1983 Ozawa et al. ..... 346/140 R
4,394,669 7/1983 Ozawa et al. ..... 346/140 R
4,410,900 10/1983 Terasawa ..... 346/140 R
4,510,510 4/1985 Terasawa ..... 346/140 R
4,543,589 9/1985 Terasawa ..... 346/140 R
4,559,543 12/1985 Toganoh et al. ..... 346/140 R
4,600,931 7/1986 Terasawa ..... 346/140 R
4,628,333 12/1986 Terasawa ..... 346/140
4,684,963 8/1987 Naka ..... 346/140 R
4,847,637 7/1989 Watanabe et al. ..... 346/140 R

FOREIGN PATENT DOCUMENTS 0273362 7/1988 European Pat. Off. .
2184066 6/1987 United Kingdom .

*Primary Examiner*—Joseph W. Hartary
*Attorney, Agent, or Firm*—Fitzpatrick, Cella, Harper & Scinto

[57] ABSTRACT

A discharge restoring device for an ink jet recording apparatus, comprises a cap member for covering a plurality of discharge openings for discharging ink, and a suction means for sucking the ink and/or air from the plurality of discharge openings through the cap member, wherein a main communication port communicating the suction means with the interior of the cap member is provided at an upper portion of the cap member. Another communication port may be provided in the lower portion of the cap.

29 Claims, 3 Drawing Sheets

INK DISCHARGE RECOVERY DEVICE HAVING AT LEAST ONE SUCTION-APPLYING CONDUIT LOCATED AT A PARTICULAR POSITION IN A CAPPING MEMBER AND AN INK JET RECORDING APPARATUS INCORPORATING THE DEVICE

BACKGROUND OF THE INVENTION

1. Field of the Invention

The present invention relates to an ink jet recording apparatus, and, more particularly, it relates to a discharge recovery or restoring device for an ink jet recording apparatus, which is provided with a cap capable of covering a recording liquid discharge surface to prevent the jamming of discharge openings of a recording head and to prepare initial charge or introduction of a recording liquid and to permit suction of ink (recording liquid) and/or air.

2. Related Background Art

In a recording head used with an ink jet recording apparatus, flying drops of recording liquid are created by discharging the recording liquid from minute or small discharge ports or openings each having a diameter of the order of about 40–50 μm. However, with such a construction, there is a tendency for bubbles to accumulate in liquid passages into which the recording liquid is introduced, and dust stuck about and around the discharge openings and/or solidification of the recording liquid may cause non-discharge of the recording liquid (from the discharge openings) and deviation of the discharged liquid drops with respect to a recording medium.

For these reasons, in the past, as shown in U.S. Pat. No. 4,600,931 in order to eliminate the above drawbacks and to facilitate the initial introduction of the recording liquid to the liquid passages of the recording head, for example, when the recording head is used again after it is dormant for a long time, a suction operation indentified as a restoring operation has been utilized by covering the recording liquid discharge face of the recording head by means of a cap member.

Such a cap member was so constructed that the recording head, brought into a home position was covered by the cap member and the recording liquid was sucked through the discharge openings arranged on the discharge face by means of an appropriate suction means communicating with the cap member.

FIG. 1 shows an example of a cap member of the conventional discharge restoring device, such as shown in the U.K. Patent Laid-Open No. GB-2184066 A. This Figure shows a condition that a front plate 3 of a recording head 2 is covered by a cap member 1. The recording head 2 includes a plurality of discharge openings 4 arranged on the front plate 3 along an up-and-down direction, and a plurality of liquid passages 6 for communicating a common liquid chamber 5 with the corresponding discharge openings to direct the recording liquid in the liquid chamber 5 to the discharge openings 4. When the recording operation is started, the recording liquid is discharged from the discharge openings 4 by means of discharge energy generating means (not shown) such as piezo-electrical elements, electrical-thermal converters and the like.

When the cap member 1 is mounted on the front plate 3 of the recording head 2 (as shown), a space 8 defined by the plate 3 and cover 1 is sealed fluid-tight with respect to the atmosphere by engaging an elastic seal 7 (such as a silicone rubber ring, butyl rubber ring and the like) arranged on a peripheral edge of the cap member 1 with the front plate 3. The cap member 1 has a communication port 9 at a lower portion of the space or cavity 8, which port 9 is communicated with an external suction pump 10. In this condition, air in the cavity 8 is sucked through the communication port 9 by the suction pump 10 to create pressure lower than atmospheric pressure in the cavity 8, thus introducing the recording liquid into the cavity 8 through the discharge openings 4 and then exhausting the recording liquid from the cavity to an appropriate exhaust liquid tank (not shown) by the action of the suction pump 10.

By the way, in a conventional restoring device of this kind, the communication port 9 was positioned in the lower portion of the cavity 8 of the cap member 1 so as not to leave the recording liquid after the liquid was drawn through the communication port, thus preventing the liquid from dropping out of the cavity, and preventing contamination of the apparatus, when the cap member 1 was separated from the front plate of the recording head 2.

However, when a recent multi-nozzle recording head having a great number (for example, 128) of the liquid passages and discharge openings is used, for example during the initial introduction of the recording liquid into the liquid chamber 5, as shown by a hatched line in FIG. 1, the recording liquid is drawn or sucked through the discharge openings situated in the lower portion (i.e., not through all of the discharge openings) before the liquid chamber 5 is completely filled with the recording liquid, with the result that the restoring operation has been completed before the whole liquid chamber is filled with the recording liquid (i.e., before the discharge openings situated in the upper portion are filled with the recording liquid). Thus, in the conventional multi-nozzle recording head, there was a problem that, when the recording operation was initiated after such restoring operation, the recording liquid was not discharged from the discharge openings situated in the upper portion, whereby complete images as desired could not be recorded on the recording medium.

On the other hand, in a recording head of a full-line type recording apparatus in which recording operation is performed by discharging the recording liquid from the discharge openings of the recording head while it is stationary with respect to the recording medium, a great number (for example, about 1792) of the discharge openings are arranged substantially along a single line.

In such a recording head of the full-line type, since the array of the discharge openings extends substantially in a horizontal direction, the distance between two discharge openings situated on both ends of the array is relatively large, and accordingly, the length of the common chamber which must be communicated with all of the discharge openings is also relatively large in the horizontal direction. Thus, also in this case, if, by utilizing the suction effect through the cap member, the recording liquid is introduced into the recording head and the restoring operation is performed as in the above-mentioned case, there arises the same problem as described above.

That is to say, if the communication port leading to the suction pump is provided at the left end of the cap member, the liquid passages situated at the right side of the recording head will not be filled with the recording liquid, whereas if the communication port is provided at the right end of the cap member, the liquid passages situated at the left side of the head will not be filled with the recording liquid.

SUMMARY OF THE INVENTION

An object of the present invention is to provide a restoring device and an ink jet recording apparatus having such restoring device, which can solve the abovementioned problems, and wherein all of the liquid passages including uppermost and lowermost ones or leftmost and rightmost ones are completely filled with a recording liquid and the recording liquid is sucked through all of discharge openings, so that the effective discharge can be effected when a recording operation is started again.

Another object of the invention is to provide a discharge restoring device for an ink jet recording apparatus, which comprises a cap for covering a plurality of discharge openings for discharging ink, and a suction means for sucking the ink and/or air from the plurality of discharge openings through the cap, and wherein a communication port communicating the suction means with the interior of the cap is provided at an upper portion of the cap.

Another object of the present invention is to provide an ink jet recording apparatus which comprises a recording head having a plurality of discharge openings provided along an up-and-down direction for discharging ink, a cap for covering the plurality of discharge openings, a suction means for sucking the ink and/or air from the discharge openings through the cap, a shifting means for shifting the cap in a position where the cap covers the plurality of discharge openings, and a drive means for driving the suction means after the plurality of discharge openings are covered by the cap by means of the shifting means, and wherein a communication port communicating the suction means with the interior of the cap is provided at an upper portion of the cap and the ink and/or air are sucked through the communication port by the suction means.

A further object of the present invention is to provide a discharge restoring device for an ink jet recording apparatus, which comprises a cap for covering a plurality of discharge openings for discharge ink, and at least one suction means for sucking the ink and/or air from the plurality of discharge openings through the cap, and wherein the cap has a plurality of communication ports communicating with the suction means and the ink and/or air are sucked, through the communication ports.

A still further object of the present invention is to provide an ink jet recording apparatus which comprises a recording head having a plurality of discharge openings for discharging ink, a cap for covering the plurality of discharge openings, a suction means for sucking the ink and/or air from the discharge openings through the cap, a shifting means for shifting the cap in a position where the cap covers the plurality of discharge openings, and a drive means for driving the suction means after the plurality of discharge openings are covered by the cap by means of the shifting means, and wherein the cap has a plurality of communication ports communicating with the suction means and the ink and/or air are sucked through the communication means.

Another object of the present invention is to provide an ink jet recording apparatus which can suck or draw ink and/or air through all of discharge openings by sucking the ink and/or through a main communication port provided at an upper portion of a sealed cavity, thus filling all of liquid passages and a common chamber with the ink completely, and thereafter can empty the cavity by exhausting the ink (recording liquid) in the cavity through a secondary communication port, thereby preventing the contamination of the apparatus when a cap member is separated from a recording head of the apparatus.

DETAILED DESCRIPTION OF THE PREFERRED EMBODIMENTS

Figure 1:
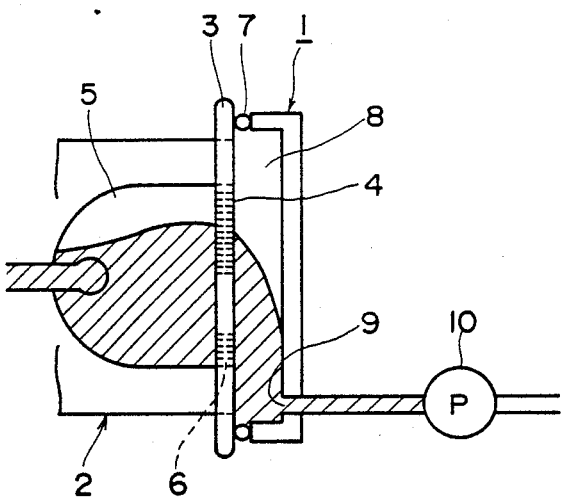
FIG. 1 PRIOR ART
FIG. 1 is a schematic sectional view showing an example of a convention discharge restoring device for an ink jet recording head.

The present invention will now be fully and concretely explained in connection with embodiments shown in the drawings. However, it should be noted that the present invention is not limited to such embodiments, but various modifications may be adopted.

[First Embodiment]

First of all, a first embodiment shown in FIG. 2 will be explained.

A cap member 11 is provided with a main suction port or communication port 12 communicating with an upper portion of a space or cavity 8 of the cap member, and a second suction port or communication port 13 communicating with a lower portion of the cavity 8. The communication ports 12 and 13 are communicated with a pump 14 through communication conduits or suction paths 12A and 13A, respectively, so that a recording liquid and/or air can be drawn or sucked from the cavity 8 through both of the communication ports 12 and 13. A diameter of the suction path 12A is larger than that of the suction path 13A. The suction paths, i.e., communication conduits 12A and 13A, are made of the same material; thus, due to the difference in diameter as stated above, channel or flow the communication conduit 12A is smaller than that of the communication conduit 13A. Alternatively, the channel resistances of the communication conduits may be differentiated as above, for example, by changing the dimensions of the suction ports and/or making walls of the conduits with different rough surfaces.

With the construction mentioned above, when a recording head 2 is moved to a home position in order to perform initial introduction of the recording liquid into a common chamber 5 and liquid passages 6 of the head, the cap member 11 is shifted to cover a discharge face 3A of a front plate 3 of the recording head 2, then the air is sucked from the cavity 8 by the suction pump 14, thereby decreasing the pressure in the cavity 8, with the result that the recording liquid is introduced from the common liquid chamber 5 and liquid passages 6 and then introduced into the cavitY 8 through discharge openings 4.

Figure 2:
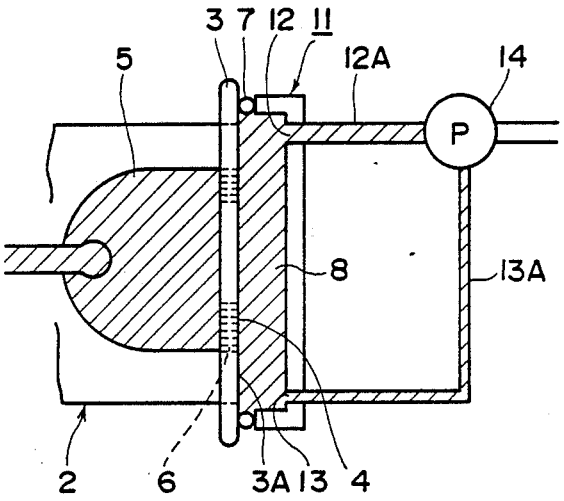
FIG. 2 is a schematic sectional view showing a discharge restoring device for a recording head of an ink jet recording apparatus according to a first embodiment of the present invention.

In the illustrated first embodiment, during the suction operation, if the recording liquid is introduced in the manner shown in FIG. 1 to leave an air space or unfilled area in upper portions of the chamber 5 and cavity 8, since the air is continuously sucked through the main communication port 12 by the suction pump 14, the chamber 5, liquid passages 6 and cavity 8 are completely filled with the recording liquid as shown by a hatched portion in FIG. 2 for an extremely short time with less power, without leaving the air in the cavity as in the conventional device. Thereafter, by switching the pump to cooperate with the second communication conduit 13A, the recording liquid in the cavity 8 is completely drawn through the second lower communication port 13, thus emptying the cavity so that the cap member 11 can be separated from the recording head 2 without contamination of the recording apparatus.

[Second Embodiment]

Next, a second embodiment of the present invention will be explained with reference to FIG. 3.

Figure 3:
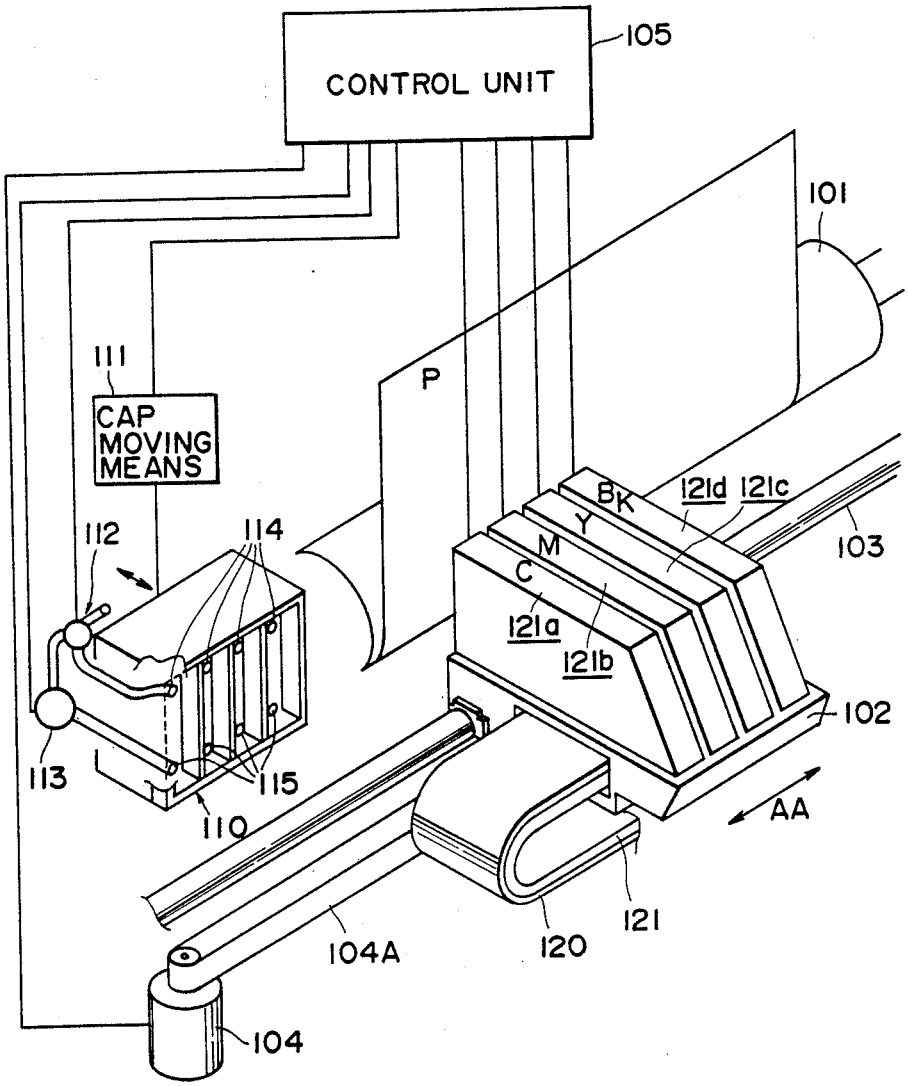
FIG. 3 is a schematic view showing an ink jet recording apparatus according to a second embodiment of the present invention.

FIG. 3 shows an ink jet recording apparatus according to the second embodiment of the present invention.

In this ink jet recording apparatus, recording heads 121*a*, 121*b*, 121*c* and 121*d* can perform the recording operation while moving in a direction shown by an arrow AA, with respect to a recording medium P brought into a recording position by means of a platen roller 101 as a conveying means. The recording heads 121*a*, 121*b*, 121*c* and 121*d* can discharge cyan ink, magenta ink, yellow ink and black ink, respectively. The recording heads are mounted on a shiftable carriage 102 guided along a guide bar 103, so that the heads can be moved to perform a scanning operation. The carriage 102 is driven by a driving motor 104 through a belt 104A. Ink supply conduits 121 for supplying a predetermined inks to the corresponding recording heads are fixed to a conventional flexible cable 120 to move together with it and are connected to corresponding ink tanks (not shown).

When the discharge restoring operation is performed, the recording heads 121*a*–121*d* positioned in the home position are covered by a cap member 110. The cap member includes cavities associated with the corresponding recording heads. The suction system of this embodiment is substantially the same as that of the first embodiment described above, except that a vent valve 112 is provided in the communication conduit in its intermediate portion for communicating the corresponding cavity with the atmosphere.

That is to say, in operation, first of all, the cap member 110 is shifted to cover the discharge openings of the recording heads by a cap-moving shifting means 111. Thereafter, when a signal for initiating the restoring operation is inputted to a control unit 105, the control unit 105 switches the three-way valves 112 to connect pumps 113 to corresponding communication ports 114, then energizes the pump 113 to create the pressure difference between the cap member and the atmosphere, thus sucking the ink and/or air from the discharge openings of the recording heads 121*a*–121*d* through the communication ports 114, 115 provided on the cap member 110.

After a predetermined period of time is elapsed, the control unit 105 switches the three-way valves 112 to vent the cavities of the cap member 110 to the atmosphere, thus sucking the inks filling the corresponding cavities through the lower communication ports 115 to empty the cavities and introduce the air into the cavities through the valves 112.

In this way, according to this second embodiment, it is possible to maintain the discharge openings in a good condition and exhaust the inks in the cap member 110 positively. While the three-way valve 112 and the pump 113 are shown only in association with the recording head 121*a*, these elements 112, 113 may be provided for each of the recording heads (each of the colored inks) or may be provided in common for all of the colored inks.

Further, each of the recording heads may include the ink tank therein and may be removably mounted on the carriage individually.

[Third Embodiment]

Figure 4:
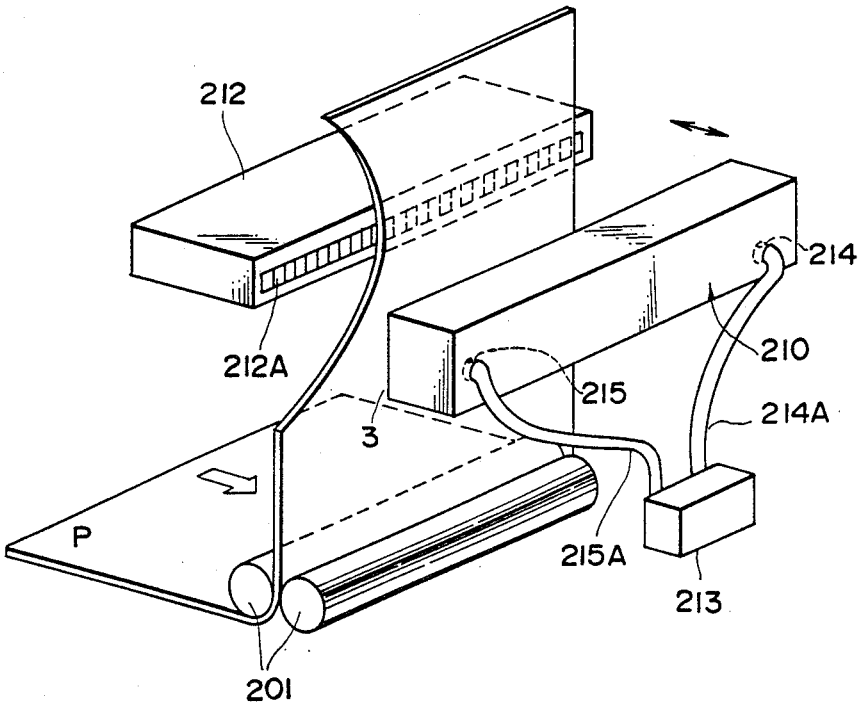
FIG. 4 is a perspective view of an ink jet recording apparatus according to a third embodiment of the present invention.

Lastly, a third embodiment of the present invention will be explained with reference to FIG. 4 showing an ink jet recording apparatus of a full-line type according to the third embodiment cf the present invention.

The recording apparatus includes a recording head 212 which can perform the recording operation while stationary with respect to a recording medium P, and a roller 201 for conveying the recording medium P.

A cap 210 is so constructed as to move and cover discharge openings 212A of the recording head 212 in an inoperative condition. The cap 210 includes communication ports 214 and 215 communicated with a suction pump 213 through corresponding communication conduits 214A and 215A, thus communicating the interior of the cap 210 with the suction pump 213. The communication port 215 is positioned in confronting relation to the leftmost (FIG. 4) discharge opening 212A, whereas the communication port 214 is positioned in confronting relation to the rightmost discharge opening 212A.

In this way, according to this third embodiment, since the cap is communicated with the suction generating source, at plural points, preferably, at both ends of the cap, it is possible to decrease the difference in suction forces for the respective discharge openings and to perform the effective restoring (suction) operation even in the recording head of full-line type.

In the recording heads illustrated in the abovementioned embodiments, it is preferable to adopt a method of producing images with a recording liquid that utilizes thermal energy for forming drops of the recording liquid. And, it is desirable to provide electrical-thermal converters in correspondence to the respective discharge openings to generate the thermal energy.

Such recording head can preferably be used since is easy to form a multi-orifice construction using this arrangement In the present invention the communication ports communicating with the interior if the cap member are provided at the upper portion of the cap member, "the upper portion" is defined to be above a position respect to a center, or a center in the direction of gravity (i.e., vertical), of an array of discharging openings in respective recording heads or more preferably above a position corresponding to the uppermost discharge opening (FIG. 2).

As mentioned above, according to the illustrated embodiments of the invention, since the communication port communicating with the suction means is arranged at least at an upper portion of a sealed space defined by mounting the cap member against the discharge face of the recording head, during the restoring operation for the recording head, the air is sucked from the sealed cavity through the upper portion thereof, whereby the recording liquid can be introduced into the cavity through all of the discharge openings including the upper ones, thus completely filling the liquid chamber and all of the liquid passages with the recording liquid. Further, by providing a plurality of communication ports and associated communication conduits communicating with the sealed cavity of the cap member, it is possible to perform more effective initial introduction of the recording liquid and to facilitate the ejection of the recording liquid from the cavity of the cap member.

I claim:

1. A discharge recovery device for an ink jet recording apparatus, the device comprising:

a cap member for covering a plurality of discharge openings for discharging ink to record on a recording medium;

suction means for sucking ink and/or air from said plurality of discharge openings through said cap member; and a communication port at an upper portion of said cap member above the uppermost of said plural discharge openings for communicating said suction means with the interior of said cap member.

2. A discharge recovery device according claim 1, further including a second communication port for communicating said suction means with the interior of said cap member.

3. A discharge recovery device according to claim 2, wherein said second communication port is provided at a lower portion of said cap member.

4. A discharge recovery device according to claim 3, wherein said first-mentioned communication port and said second communication port are provided with a respective communication conduit to said suction means and the flow resistance of said first-mentioned communication conduit provided with said communication port is smaller than that of said communication conduit provided with said second communication port.

5. A discharge recovery device according to claim 1, wherein said suction means comprises a pump for creating a pressure difference.

6. A discharge recovery device for an ink jet recording apparatus, the device comprising:

a cap member for covering a plurality of discharge ports arranged in a particular direction for discharging ink therethrough to record on a recording medium;

suction means for sucking ink and/or air from said plurality of discharge ports through said cap member; and a plurality of communicating means for communicating said cap member with said suction means, wherein said communicating means are connected to a plurality of communicating sections in said cap member at areas opposite said discharge ports on both ends of the direction in which said discharge ports are arranged.

7. A discharge recovery device according to claim 6, wherein said discharge ports are arranged vertically, said communicating means include first communicating means and second communicating means respectively connected to a first communicating section provided at an area in said cap member opposite said discharge ports at the upper end of said arrangement of said discharge ports a second communicating section provided at an area in said cap member opposite said discharge ports, and the flow resistance of said first communicating means is smaller than that of said second communicating means.

8. A discharge recovery device according to claim 6, wherein said discharge ports are arranged horizontally, said communicating means include first communicating means and second communicating means respectively connected to a first communicating section provided at an area in said cap member opposite said discharge ports at one end of said arrangement of said discharge ports and a second communicating section provided at an area in said cap member opposite to said discharge ports at the other end of said arrangement of said discharge ports, and the flow path resistance of said first communicating means is smaller than that of said second communicating means.

9. A discharge recovery device according to claim 6, wherein a valve mechanism is provided in at least one of said plural communicating means.

10. A discharge recovery device according to claim 9, wherein said valve mechanism can communicate with the atmosphere.

11. A discharge recovery device according to claim 6, wherein said suction means comprises a pump for creating a pressure difference.

12. A ink jet recording apparatus comprising:

a recording head having a plurality of discharge ports arranged in a particular direction for discharging ink therethrough to record on a recording medium;

a cap member for covering said plurality of discharge ports;

suction means for sucking ink and/or air from said plurality of discharge ports through said cap member;

a plurality of communicating means for communicating said cap member with said suction means;

moving means for moving said cap member to a covering position for covering said discharge ports; and driving means for driving said suction means when said moving means moves said cap member to the covering position, wherein said communicating means are connected to a plurality of communicating sections in said cap member at an area opposite said discharge ports on both ends of the direction in which said discharge ports are arranged and ink and/or air is sucked through said plural communicating means by driving said suction means.

13. An ink jet recording apparatus according to claim 12, wherein said discharge ports are arranged vertically, said communicating means include first communicating means and second communicating means respectively connected to a first communicating section provided at an area in said cap member opposite said discharge ports at the upper end of said arrangement of said discharge ports and a second communicating section provided at an area in said cap member opposite said discharge ports at the lower end of said arrangement of said discharge ports, and the flow resistance of said first communicating means is smaller than that of said second communicating means.

14. An ink jet recording apparatus according to claim 12, wherein said discharge ports are arranged horizontally, said communicating means include first communicating means and second communicating means respectively connected to a first communicating section provided at an area in said cap member opposite said discharge ports at one end of said arrangement of said discharge ports and a second communicating section provided at an area in said cap member opposite said discharge ports at the other end of said arrangement of said discharge ports, and the flow resistance of said first communicating means is smaller than that of said second communicating means.

15. An ink jet recording apparatus according to claim 12, wherein a valve mechanism is provided in at least one of said plurality communicating means.

16. An ink jet recording apparatus according to claim 15, wherein said valve mechanism can communicate with the atmosphere.

17. An ink jet recording apparatus according to claim 12, wherein said suction means comprises a pump for creating a pressure difference.

18. An ink jet recording apparatus according to claim 12, wherein said recording head includes an ink tank for containing ink and is detachably mounted on an carriage for moving said recording head to form an image on the recording medium.

19. An ink jet recording apparatus according to claim 12, wherein said discharge ports are disposed along the recording width of the recording medium.

20. An ink jet recording apparatus according to claim 12, wherein said recording head includes electrothermal converting elements for generating thermal energy to discharge ink through said discharge ports.

21. An ink jet recording apparatus comprising:

a recording head having a plurality of discharge ports arranged vertically for discharging ink therethrough to record on a recording medium;

a cap member for covering said plurality of discharge ports;

suction means for sucking ink and/or air from said plurality of discharging ports through said cap member;

first and second communicating means for communicating said cap member with said suction means, said first and second communicating means being respectively connected to a first communicating section provided at an area in said cap member opposite said discharge ports at the upper end of said arrangement of said discharge ports and a second communicating section provided at an area in said cap member opposite to said discharge ports at the lower end of said arrangement of said discharge ports;

moving means for moving said cap member to a covering position for covering said plural discharge ports; and driving means for driving said suction means when said moving means moves said cap member to said covering position, wherein said driving means drives said suction means to apply suction through both said first and second communicating means when suction is initiated and through said second communicating means after ink fills the closed space formed between said recording head and said cap member when said cap member is in the covering position.

22. An ink jet recording apparatus according to claim 21, wherein said upper area is above a central area of said arrangement of said discharge ports.

23. An ink jet recording apparatus according to claim 21, wherein said upper area is corresponds to the upper most end of said arrangement of said discharge ports.

24. An ink jet recording apparatus according to claim 21, wherein said upper area is above an area corresponding to the uppermost end of said arrangement of said discharge ports.

25. A discharge recovery device for an ink jet recording apparatus, the device comprising:

a cap member for covering a surface of a recording head having a plurality of discharge ports for discharging ink therethrough to record on a recording medium;

suction means for sucking ink and/or air from said plural discharge ports through said cap member; and first and second communicating means for communicating said cap member with said suction means, wherein said suction means applies suction through both said first and second communicating means when suction is initiated and solely through said second communicating means after ink fills the closed spaced formed between said recording head and said cap member when said cap member covers said plural discharge ports.

26. A discharge recovery device according to claim 25, wherein said plural discharge ports are arranged vertically, said first communicating means is located at an upper side of said cap member corresponding to the uppermost end of said arrangement of said discharge ports and said second communicating means is located at a lower side of said cap member corresponding to the lowermost end of said arrangement of said discharge ports.

27. A discharge recovery device according to claim 25, wherein said plural discharge ports are arranged horizontally, said first communicating means is located at one end of said cap member corresponding to one end of said arrangement of said discharge ports and said second communicating means is located at the other end of said cap member corresponding to the other end of said arrangement of said discharge ports.

28. A discharge recovery device according to claim 25, wherein the flow path resistance of said first communicating means is smaller than that of said second communicating means.

29. A discharge recovery device according to claim 25, wherein a cross-sectional area of said first communicating means is larger than that of said second communicating means.

* * * * *

UNITED STATES PATENT AND TRADEMARK OFFICE

CERTIFICATE OF CORRECTION

PATENT NO. : 4,952,947

DATED : August 28, 1990

INVENTOR(S) : MASAYUKI KYOSHIMA

It is certified that error appears in the above-identified patent and that said Letters Patent is hereby corrected as shown below:

COLUMN 1

Line 44, "position" should read --position,--.

COLUMN 2

Line 45, "recording operation" should read --the recording operation--.

COLUMN 3

Line 49, "sucked," should read --sucked--.
Line 68, "and/or" should read --and/or air--.

COLUMN 4

Line 12, "convention" should read --conventional--.
Line 50, "flow" should read --flow resistance of--.
Line 67, "cavitY 8" should read --cavity 8--.

COLUMN 5

Line 9, "for" should read --in--.
Line 36, "a" should be deleted.

COLUMN 6

Line 20, "cf" should read --of--.
Line 50, "since is" should read --since it is--.
Line 54, "if" should read --of--.
Line 56, "respect" should read --with respect--.

UNITED STATES PATENT AND TRADEMARK OFFICE

CERTIFICATE OF CORRECTION

PATENT NO. : 4,952,947

DATED : August 28, 1990

INVENTOR(S) : MASAYUKI KYOSHIMA

It is certified that error appears in the above-identified patent and that said Letters Patent is hereby corrected as shown below:

COLUMN 9

Line 8, "plurality communicating means." should read --plural communicating means.--.

COLUMN 10

Line 7, "is" should be deleted and "upper" should read --upper- --.

Signed and Sealed this

Twenty-first Day of April, 1992

*Attest:*

HARRY F. MANBECK, JR.

*Attesting Officer*

*Commissioner of Patents and Trademarks*